United States Patent [19]

Benoit et al.

[11] Patent Number: 4,942,681

[45] Date of Patent: Jul. 24, 1990

[54] FOOT RETENTION APPARATUS FOR A SKI BOOT

[75] Inventors: Louis Benoit, Frangy; Bernard Nerrinck, La Balme De Sillingy, both of France

[73] Assignee: Salomon, S.A., Annecy Cedex, France

[21] Appl. No.: 327,896

[22] Filed: Mar. 23, 1989

[30] Foreign Application Priority Data

Mar. 29, 1988 [FR] France ..... 88 04483

[51] Int. Cl.[5] ..... A43B 5/04

[52] U.S. Cl. ..... 36/119; 36/117

[58] Field of Search ..... 139/117-121, 139/58.5; 128/611

[56] References Cited

U.S. PATENT DOCUMENTS

| | | | |
|---|---|---|---|
| 4,253,251 | 3/1981 | Saloman | 36/119 |
| 4,788,782 | 12/1988 | Pozzebon et al. | 36/119 |
| 4,823,485 | 4/1989 | Kemmer | 36/119 |
| 4,841,650 | 6/1989 | Dodge et al. | 36/119 |

FOREIGN PATENT DOCUMENTS

| | | |
|---|---|---|
| 169190 | 1/1986 | European Pat. Off. . |
| 3826236 | 2/1989 | Fed. Rep. of Germany . |
| 2343437 | 10/1977 | France . |
| 2419690 | 10/1979 | France . |
| 2514621 | 4/1983 | France . |
| 2576192 | 7/1986 | France . |
| 668165 | 12/1988 | Switzerland . |

*Primary Examiner*—Paul T. Sewell
*Assistant Examiner*—Andrew D. Meyers
*Attorney, Agent, or Firm*—Sandler, Greenblum & Bernstein

[57] ABSTRACT

A ski boot with a rigid shell having a foot retention system that is adapted to maintain the forefoot. At least one maintenance element at least partially surrounds the foot by forming a flexible arc between the plantar support zone and the top of the foot. The maintenance element includes at least two flexible elements that straddle a sensitive part of the foot. An activation mechanism adjusts the flexible elements to modify their position against the forefoot.

19 Claims, 3 Drawing Sheets

FOOT RETENTION APPARATUS FOR A SKI BOOT

BACKGROUND OF THE INVENTION

1. Field of the Invention

The invention relates to ski boots comprising a rigid shell having at least one foot retention system positioned in the interior, and relates in particular to a foot retention system with an action zone positioned on the forefoot.

2. Description of Background and Relevant Information

Numerous ski boots of this type, equipped with a foot retention system adapted to maintain the forefoot, have been developed.

There are known boots in which the foot retention system comprises maintenance means which at least partially surrounds the forefoot and means activating the maintenance means to apply it against the forefoot. For example, French Published Application Nos. 2,514,621, 2,576,192 and 2,419,690 show boots of this type. More particularly, the maintenance means consists of relatively flexible and wide straps for better distribution of the pressure and where the tension can be varied to cause the coming together of the liner on the foot, thus ensuring the retention of the foot in the rigid shell of the boot. These straps surround the foot, either totally, such as is described in French No. 2,576,192, or partially, such as is described in French No. 2,514,621, and are situated substantially in front of the zone of the instep to be applied against, in particular, the forefoot at the level of the metatarsals.

In the example of French No. 2,419,690, a foot retention system is disclosed as comprising two straps connected to a single tightening apparatus by means of a connecting rod which acts as a distribution plate. One of the straps extends in the zone of the instep and the other strap extends in the zone of the forefoot. Thus, by adjusting the tightening of the apparatus, one simultaneously ensures the retention of the forefoot and of the heel without differentiating the forces applied on the zones of the foot by virtue of the distribution of the forces at the level of the connecting rod.

These foot retention systems which have just been described are effective but nevertheless are disadvantageous because they act on the foot in a uniform manner over the entire pressure zone of the straps without avoiding certain sensitive lateral points of the foot such as the bony projection (apophysis styloid) of the fifth metatarsal, the connection between the metatarsal and the phalange, or the external arch. These sensitive points must in effect be protected from overly hard contact so as not to risk creating bone spurs, cramps, numbness, etc.

SUMMARY OF THE INVENTION

An object of the present invention is to provide a ski boot having a rigid shell and a foot retention system positioned within the interior of the rigid shell, the foot retention system having at least one foot maintenance element for at least partially surrounding a foot, the foot maintenance element being connected at one end to the boot in the plantar support zone of the foot and at the other end to an activation means for modifying the position of the maintenance element against the foot, the foot maintenance element having at least two flexible elements which extend transversely to the longitudinal axis of the boot and between the rigid shell and the foot in the zone of the forefoot, the flexible elements being spaced apart by a distance so as to straddle a sensitive part of the foot and wherein the other end of the maintenance element includes a half-loop and the activation means include a return, and wherein the half loop is wound around the return. At least one of the flexible elements may be elastically deformable.

In one embodiment, the maintenance element is a single flexible connection forming the half-loop, the flexible connection straddling the sensitive point of the foot.

In another embodiment, the maintenance element is formed by two straps and a flexible connection connecting the upper end of the two straps, thereby forming the half-loop around the return.

In still another embodiment, the maintenance element is formed by a flat flexible element and a flexible cable connected to an end of the flat flexible element, thereby forming the half-loop around the return.

The return may be a pulley connected to the activation means or it may take the form of a mushroom-shaped element that is connected to the activation means distribution plates are interposed between the flexible elements and the foot. The distribution plates include guides for determining the position of the flexible elements and are connected to a portion of the boot located in the plantar support zone. The distribution plates may freely slide along the length of the flexible elements.

In another embodiment, the maintenance element is formed by two flexible elements extending on one side of the foot, a supplemental maintenance element extending on the other side of the foot, the two flexible elements and the supplemental maintenance element being connected to the same activation means. The maintenance element and the supplemental maintenance element each include an adjustment nut mounted on a bolt, whereby the maintenance element and the supplemental maintenance element are simultaneously controlled by rotation of a lever connected to the bolt.

At least one of the flexible elements may be unitarily formed with a portion of the boot located in the plantar support zone. The boot includes a liner and the flexible elements extend between the liner and the interior of the rigid shell.

BRIEF DESCRIPTION OF THE DRAWINGS

The invention will be better understood from the description which follows with reference to the drawings illustrating, by way of non-limiting example, various embodiments of the invention, wherein.

DETAILED DESCRIPTION OF THE PREFERRED EMBODIMENTS

The present invention overcomes in a simple and effective manner the disadvantage of the prior art mentioned above, on the one hand, by positioning a foot maintenance means acting simultaneously on the various zones of the forefoot by avoiding the one or more sensitive points of the forefoot to preserve all pressure, and on the other hand, by associating with the means maintaining the foot an automatic distribution apparatus of the tightening forces on the retention zones of forefoot.

The ski boot according to the invention comprises at least one foot retention system positioned in the interior of the rigid shell. This system has at least one maintenance element that at least partially surrounds the foot of the skier by generally forming a flexible arc of a circle between the plantar support zone where it is affixed and the top of the foot where it cooperates with activation means adapted to modify its position against the foot. The maintenance element comprises two flexible flat elements extending jointly between the liner and the interior of the shell base transversely to the longitudinal axis of the boot in the zone and at the sides of the forefoot. Furthermore, the flexible elements are, on the one hand, spaced from one another by a distance corresponding to the size of a sensitive point of the foot and, on the other hand, their upper ends being connected by means of a flexible connection in the form of a half-loop which is supported on a return movable by the activation means.

Figure 1:
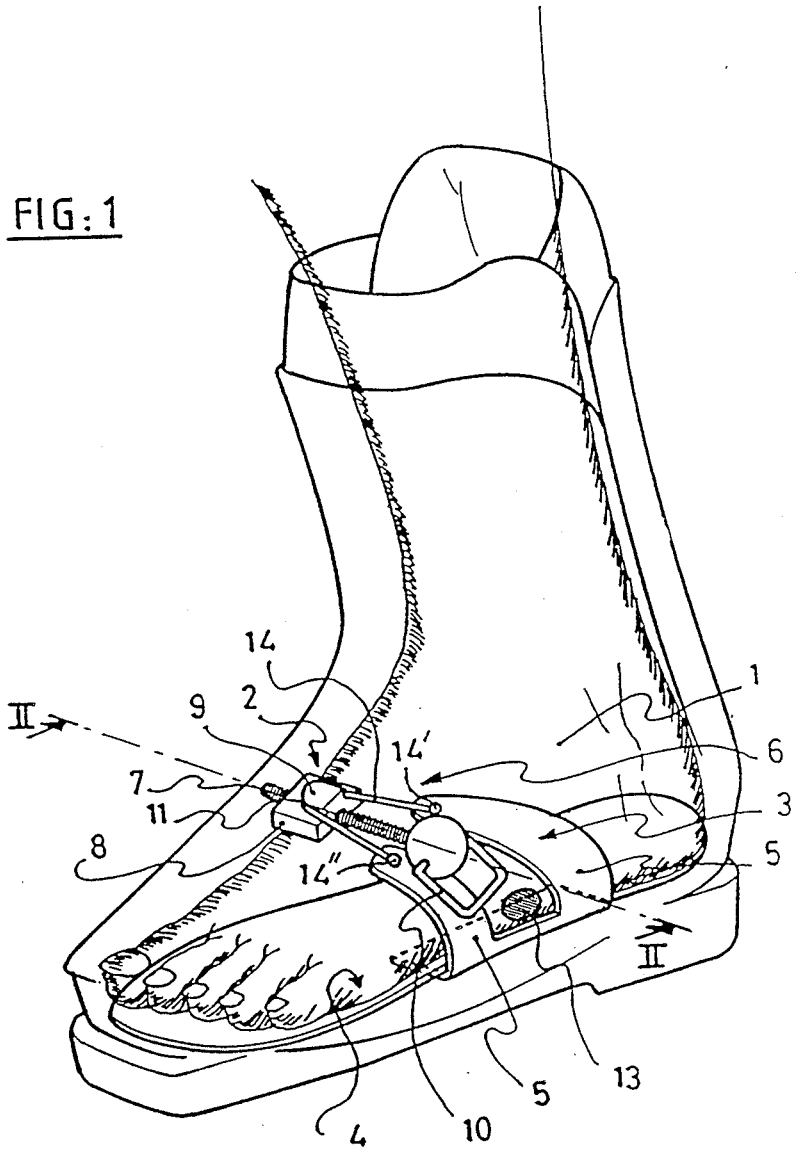
FIG. 1 illustrates a schematic view of a ski boot comprising a foot retention system according to the invention positioned in the zone corresponding to the forefoot of the skier.
Figure 2:
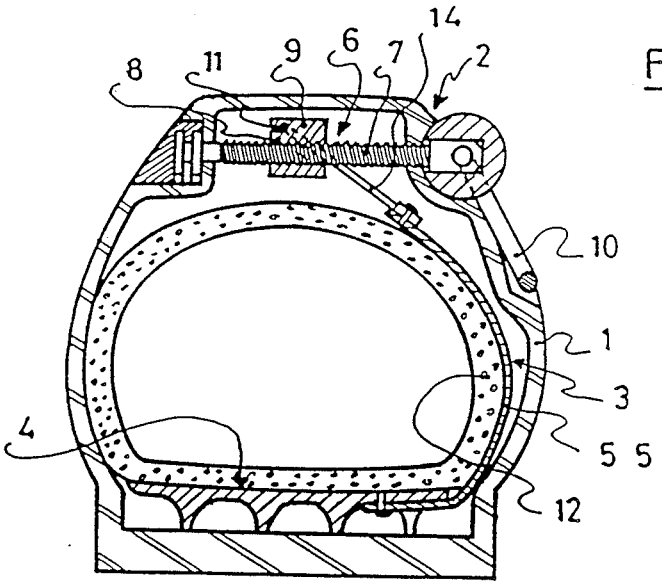
FIG. 2 is a transverse cross-sectional view along II—II of FIG. 1, and illustrates more particularly the attachment of a foot maintenance element provided with activation means.

FIGS. 1 and 2 illustrate a ski boot having a rigid shell 1 provided with a foot retention system 2 according to the invention. This system is positioned on the interior of the rigid shell 1 and has a maintenance element 3 which extends from the external side of the boot transversely to the longitudinal axis of the boot in the zone of the forefoot. This maintenance element 3 comprises two flexible elements 5 and 5', for example straps, which are affixed to the plantar support zone 4 and which go up over the top of the forefoot where they are connected by means of a flexible attachment 14 to activation means 6.

These activation means 6 comprise a nut-bolt system, having a bolt 7 and nut 8, which is maneuverable from the exterior of the rigid shell 1 by means of a pivotable lever 10. A return 9 in the form of a mushroom-shaped element is affixed to or unitarily formed with the nut 8. A flexible attachment 14 which forms a half-loop 11 whose ends are attached to the upper end of the flexible elements 5 and 5' are wound around the return 9.

According to the invention, the flexible elements 5 and 5' are spaced from one another to go around a sensitive point 13 of the foot, such as the bony projection (apophysis styloid) of the fifth metatarsal, and jointly extend between the liner 12 and the interior of the rigid shell 1 until the upper portion of the forefoot where they are connected to the activation means by means of the flexible attachment 14. Thus, when one causes the displacement of nut 8 along the length of bolt 7 by rotation of lever 10, half-loop 11 formed by the flexible attachment 14 wound around return 9 is displaced along the length of bolt 7. In the direction of tightening, for example, each of the ends 14', 14'' of connection 14 pulls simultaneously on the straps 5 and 5' The tightening force is then automatically distributed on each of the straps 5 and 5' by virtue of the flexible attachment 14 which equalizes the tension on both sides of return 9 on which it rests and freely slides. Such a construction of the distribution apparatus for tightening and adaptation to the anatomy of the foot is characterized by the simplicity of a single flexible connection 14 around a return 9, and by its ease of use. The flexible attachment 14 passes on both sides of bolt 7, which allows for an easy adaptation to the interior of the rigid shell 1 in the zone of the forefoot with activation means 6 such as nut-bolt system 7 and 8, but likewise could be used with other known systems, such as, for example, maneuverable cam mechanisms such as taught by French No. 2,343,437, the disclosure of which is hereby incorporated by reference.

Figure 3:
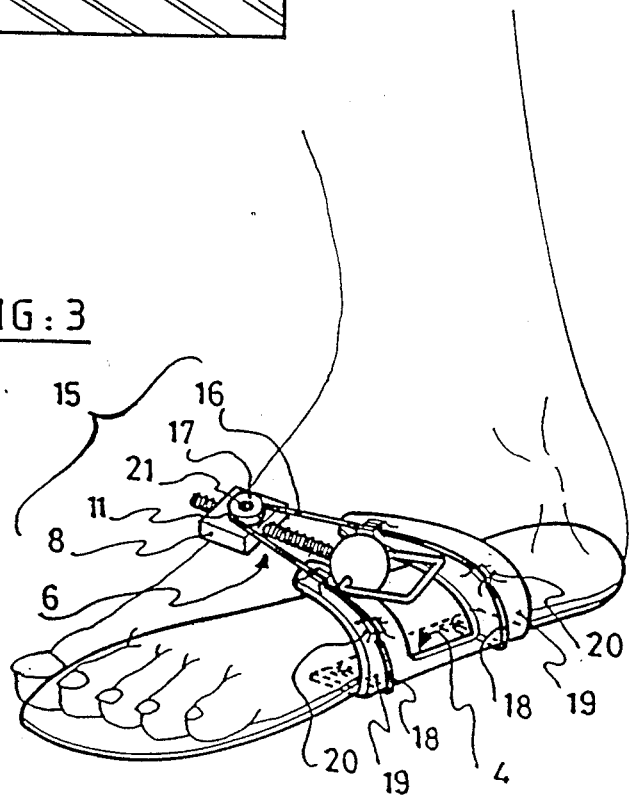
FIG. 3 illustrates an alternative embodiment of the invention in which the foot maintenance element is a flexible connection in the form of a half-loop cooperating with flexible distribution elements.

FIG. 3 illustrates an alternative embodiment of the invention in which the foot retention system 15 comprises a maintenance element constituted by a single flexible attachment, such as a cable 16. The latter forms a half-loop 11 which rests, as previously described with reference to FIGS. 1 and 2, on a return 17 that is connected to the activation means 6 while the two ends 18 and 18' of the flexible element are on both sides of the return, partially surrounding the forefoot and are affixed to the plantar support 4 of the boot. To avoid the localized pressures of the flexible attachment 16 on the foot, flexible distribution plates 19 and 19' are preferably interposed between the flexible attachment 16 and the foot and/or the liner 12, as shown in FIG. 3.

These distribution plates 19 and 19' comprise guides 20 and 20' with which the ends 18 and 18' of the flexible attachment 16 cooperate and are equally spaced from one another by a distance corresponding to the size of the sensitive point 13 of the foot. In this embodiment, the distribution plates 19 and 19' are affixed to a portion of the boot positioned in the plantar support zone 4. They can in particular be formed as a single element with an element such as the internal sole of the boot, for example. Likewise, these distribution plates 19 and 19' can be made freely slidable along the length of ends 18 and 18' and are thus not attached to the plantar support zone 4. Furthermore, in this embodiment, the return 17 is constituted by a pulley affixed to the nut 8 through an axis of rotation 21.

Figure 4:
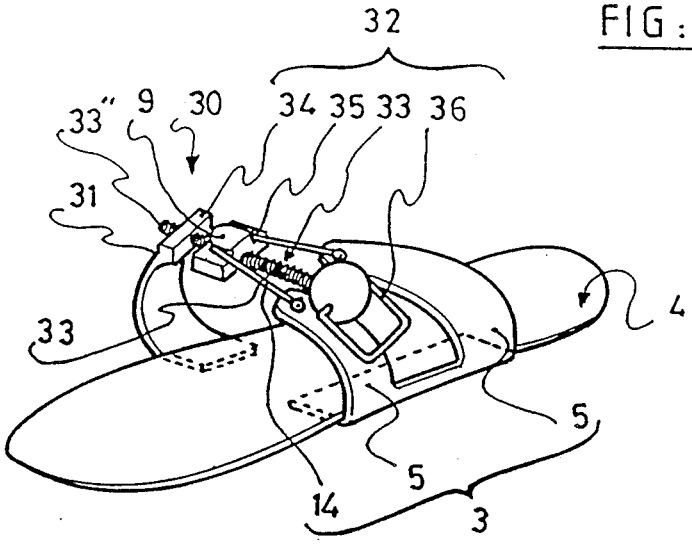
FIG. 4 illustrates another embodiment of the invention in which the maintenance element of the foot comprises two portions which extend on both sides of the forefoot and which are simultaneously movable by the common activation means.

FIG. 4 illustrates an embodiment of the invention whose foot retention system 30 comprises a foot maintenance element in two portions 3 and 31 which extend on each side of the forefoot and which are simultaneously moved by the activation means 32. This activation means comprises a bolt 33, with two oppositely threaded portions 33' and 33'', two nuts 34 and 35, to which are connected the maintenance elements 31 and 3, and a pivotable lever 36. The nuts 34 and 35 are screwed, respectively, on the threaded portions 33'' and 33' of the bolt 33. Thus, rotating the pivotable lever 36 causes the translational displacement of the nuts 34 and 35 which, depending upon the direction of rotation applied, either come together or move away from one another, thereby causing the same thing to occur with respect to the maintenance elements 3 and 31 which are connected to them. In this embodiment, the maintenance element 3 is analogous to that described in FIG. 1 and the operation of the different constituent portions such as the straps 5 and 5' and their connection 14 will not be repeated, while the maintenance element 31 is a single strap, for example.

Figure 5:
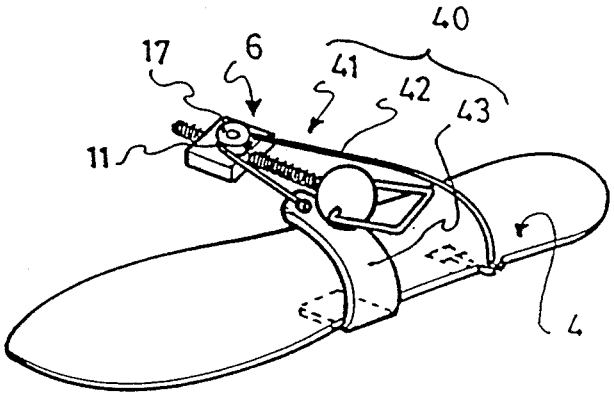
FIG. 5 illustrates another embodiment of the invention in which the maintenance element comprises a cable and a strap.

In the example of FIG. 5, the foot retention system 40 comprises a maintenance element 41 that is a flexible attachment 42, such as a cable, and a flexible element 43 which is relatively wide, such as a strap. The connection 42 is attached to the internal sole which serves as a plantar support surface 4 in the boot and rises on the side of the forefoot to form a half-loop 11 around the return 17 that is connected to the attachment means 6. The connection 42 extends from return 17 to then be connected to the upper end of the flexible element 43. Such a construction makes it possible to favorably distribute the tightening pressure over the forefoot zone corresponding to the flexible element 43 while still guaranteeing the equilibration of the forces between the flexible element 43 and the connection 42, which can thus be anchored to the sole with a minimum of dimensional constraints.

Still according to the invention, the maintenance element 3, 16, 31, 41 of the foot retention system 2, 15, 30, 40 can be made from an elastically deformable material, as can at least one of the flexible elements 5, 5', 18, 18', 42, 43 which partially surrounds the forefoot. Likewise, the flexible connection 14 that attaches the upper ends of the flexible element 5, 5' with the return 9 can also be made out of an elastically deformable material.

It is well understood that the return 9 or 17 can be associated with different activation means than 6 and 32 which have just been described and the connection of the return to the activation means can be movable and/or fixed without going beyond the scope of the invention. Furthermore, the two flexible elements 5-5', 18-18', and 42-43, of the maintenance elements 3, 16, 41, respectively, can be extended as desired over one and/or the other of the sides of the forefoot and can surround any other sensitive point of the forefoot other than the bony projection (apophysis styloid) of the fifth metatarsal which has been given by way of example only.

At least one of the flexible elements 5-5', 18-18', 43 of the maintenance element 3, 16, 41 can be made from a single element with any one of the constituent portions of the boot situated in the plantar support zone 4, such as the internal sole of the boot, for example.

Finally, although the invention has been described with reference to particular means, materials and embodiments, it is to be understood that the invention is not limited to the particulars disclosed and extends to all equivalents within the scope of the claims.

What is claimed is:

1. A ski boot having a rigid shell comprising:

a foot retention system positioned within the interior of the rigid shell, said foot retention system having at least one foot maintenance element for at least partially surrounding a foot, said foot maintenance element being connected at one end to the boot in the plantar support zone of the foot and at the other end to an activation means for modifying the position of the maintenance element against the foot, said foot maintenance element comprising at least two flexible elements which extend transversely to the longitudinal axis of the boot and between the rigid shell and the foot in the zone of the forefoot, said flexible elements being spaced apart by a distance so as to straddle a predetermined portion of the foot.

2. A ski boot having a rigid shell according to claim 1 wherein said other end of the maintenance element includes a half-loop and said activation means include a return, and wherein said half loop is wound around said return.

3. A ski boot having a rigid shell according to claim 2, wherein the maintenance element comprises a single flexible connection forming the half-loop, the flexible connection straddling the predetermined portion of the foot.

4. A ski boot having a rigid shell according to claim 2, wherein the maintenance element comprises two straps and a flexible connection connecting the upper end of the two straps, thereby forming the half-loop around the return.

5. A ski boot having a rigid shell according to claim 2, wherein the maintenance element comprises a flat flexible element and a flexible cable connected to an end of the flat flexible element thereby forming the half-loop around the return.

6. A ski boot having a rigid shell according to claim 2, wherein at least one of the flexible elements is elastically deformable.

7. A ski boot having a rigid shell according claim 2, wherein the return comprises a pulley connected to the activation means.

8. A ski boot having a rigid shell according to claim 2, wherein the return is in the form of a mushroom-shaped element that is connected to the activation means.

9. A ski boot having a rigid shell according to claim 1, further comprising distribution plates interposed between the flexible elements and the foot.

10. A ski boot having a rigid shell according to claim 9, wherein the distribution plates include guides for determining the position of the flexible elements.

11. A ski boot having a rigid shell according to claim 10, wherein the distribution plates are connected to a portion of the boot located in the plantar support zone.

12. A ski boot having a rigid shell according to claim 10, wherein the distribution plates freely slide along the length of the flexible elements.

13. A ski boot having a rigid shell according to claim 1, wherein said maintenance element comprises two flexible elements extending on one side of the foot, a supplemental maintenance element extending on the other side of the foot, said two flexible elements and said supplemental maintenance element being connected to the same activation means.

14. A ski boot having a rigid shell according to claim 13, wherein said maintenance element and said supplemental maintenance element each include an adjustment nut mounted on a bolt, whereby said maintenance element and said supplemental maintenance element are simultaneously controlled by rotation of said bolt.

15. A ski boot having a rigid shell according to claim 14, and further comprising a lever connected to said bolt.

16. A ski boot having a rigid shell according to claim 1, wherein at least one of the flexible elements is unitarily formed with a portion of the boot located in the plantar support zone.

17. A ski boot having a rigid shell according to claim wherein the boot includes a liner and the flexible elements extend between the liner and the interior of the rigid shell.

18. A ski boot having a rigid shell according to claim 1, wherein the predetermined portion of the foot said flexible elements are to straddle is a sensitive portion of the foot.

19. A ski boot having a rigid shell according to claim 18, wherein the sensitive portion of the foot is the bony projection of the fifth metatarsal.

* * * * *